US008688020B2

(12) United States Patent
Clark et al.

(10) Patent No.: US 8,688,020 B2
(45) Date of Patent: Apr. 1, 2014

(54) SELF-POSITIONING STRIPPER BAR APPARATUS AND SYSTEMS FOR BELT ROLL FUSER SYSTEMS

(75) Inventors: Lawrence Arnold Clark, Webster, NY (US); Steven Matthew Russel, Bloomfield, NY (US); Stephen Bradley Williams, Marion, NY (US); Paul M. Fromm, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 165 days.

(21) Appl. No.: 13/357,429

(22) Filed: Jan. 24, 2012

(65) Prior Publication Data

US 2013/0189004 A1 Jul. 25, 2013

(51) Int. Cl.
*G03G 15/20* (2006.01)

(52) U.S. Cl.
USPC ..... 399/323; 399/322

(58) Field of Classification Search
USPC ..... 399/323
See application file for complete search history.

(56) References Cited

U.S. PATENT DOCUMENTS 6,243,556 B1 * 6/2001 Shin ..... 399/323
7,817,950 B2 * 10/2010 Burton et al. ..... 399/323

* cited by examiner

*Primary Examiner* — Clayton E Laballe
*Assistant Examiner* — Jas Sanghera
(74) *Attorney, Agent, or Firm* — Ronald E. Prass, Jr.; Prass LLP

(57) ABSTRACT

A self-positioning belt roll fuser stripping apparatus and system includes an internal pressure roll entraining a fuser belt. The internal pressure engages an external pressure roll to form a fusing nip. The internal pressure roll includes an internal pressure roll bearing to which a mounting plate is attached, allowing the mounting plate to move about a rotational axis of the internal pressure roll. A strip bar is attached to the mounting plate, and configured to force the fuser belt toward the external pressure roll. A mounting plate ski is configured to contact an external pressure roll bearing to limit movement of the mounting plate, positioning the strip shoe as desired when the mounting plate is moved to guide the strip show toward the fusing nip.

19 Claims, 5 Drawing Sheets

SELF-POSITIONING STRIPPER BAR APPARATUS AND SYSTEMS FOR BELT ROLL FUSER SYSTEMS

FIELD OF DISCLOSURE

The disclosure relates to apparatus and systems for belt-roll fuser stripping. In particular, the disclosure relates to self-positioning stripping apparatus and systems for use in belt roll fuser systems.

BACKGROUND

Related art belt-roll fusers include a hard internal pressure roll and a soft external pressure roll. The internal pressure roll, or fuser roll, and the external pressure roll, or pressure roll, may together form a fusing nip for fusing marking material such as toner to a sheet, after the sheet has received toner from a transfer station. A fuser belt may be entrained by the internal roll and three heated rolls that also contact the fuser belt, the fuser belt extending through the nip.

During a printing process, a paper sheet that is fused at the nip may stick to the fusing belt after passing through the nip. Typically, a strip shoe is implemented to strip the sheet from the fusing belt. The strip shoe may have, for example, a less than 5 mm stripping radius. The fusing belt wraps around the strip shoe causing a bend in the belt at which paper leaves the belt surface during processing. Related art fusing nips cause image quality defects such as "retacking", gloss defects such as "icicles".

SUMMARY

Related art strip shoe configurations are difficult to control. Self-position stripping apparatus and systems may eliminate the strip shoe to soft external roll configuration by including an internal pressure roll having a soft surface, and an external pressure roll having a hard surface, for example. A strip bar, for example, may be mounted to a pivoting plate system for automatically positioning the strip bar in an operating position that is close to the hard external pressure roll.

In an embodiment, belt-roll fuser stripping apparatus may include a mounting plate for mounting a stripping shoe, the mounting plate being configured to movably connect to an internal pressure roll; and a stripping shoe for stripping a sheet from a fuser belt, the stripping shoe being attached to the mounting plate. In an embodiment, apparatus may include an internal pressure roll; an internal pressure roll bearing, the internal pressure roll bearing being attached to the internal pressure roll, and the mounting plate being attached to the internal pressure roll bearing whereby the mounting plate is movably connected to the internal pressure roll.

In an embodiment, apparatus may include a fuser belt, the fuser belt being entrained by at least the internal pressure roll, the fuser belt having an internal pressure roll contact side and a sheet contact side, the fuser belt wrapping around the stripping shoe whereby the stripping shoe contacts the roll contact side of the fuser belt to angle the fuser belt.

In an embodiment, apparatus may include an internal pressure roll having a conformable surface. In an embodiment, the internal pressure roll may include a soft surface comprising rubber. The internal pressure roll bearing may be configured to permit rotation of a mounting plate about a rotational axis of the internal pressure roll. In an embodiment, a force applied to the fuser belt by the stripping shoe may adjusted by moving the mounting plate about the internal pressure roll bearing. In an embodiment, a mounting plate ski, the mounting plate ski being configured to limit rotation of the mounting plate about a rotational axis of the internal pressure roll.

In an embodiment, a mounting plate ski may be attached to the mounting plate. In an embodiment, a mounting plate ski may be configured for restricting movement of a mounting plate whereby a stripping shoe may be automatically positioned to apply a desired pressure to a roll contact side of a fuser belt.

In an embodiment of systems, self-position stripping systems may include a mounting plate, the mounting plate configured for supporting a strip shoe; an internal pressure roll; an internal pressure roll bearing, the internal pressure roll bearing being connected to the internal pressure roll, the mounting plate being attached to the internal pressure roll bearing whereby the mounting plate is movable about a rotational axis of the internal pressure roll. In an embodiment, systems may include an external pressure roll. Systems may include the internal pressure roll having soft surface, and the external pressure roll having a hard surface. Systems may include the mounting plate being spring biased, the mounting plate being biased toward an external pressure roll when the internal pressure roll is engaged with the internal pressure roll to define a fusing nip. In an embodiment, systems may include a mounting plate ski, the mounting plate being spring biased toward a first direction; an external pressure roll bearing, the external pressure bearing being movably attached to the external pressure roll, the mounting plate ski being configured to contact the external pressure roll bearing.

In an embodiment, systems may include the mounting plate being biased by a spring that applies a biasing force in a first direction that causes the mounting plate to move toward the external pressure roll, the ski being configured to contact the external pressure roll bearing whereby the external pressure roll bearing applies a force in a second direction that opposes the first direction of the biasing force. Systems may include the mounting plate being movable to and from a first position wherein the ski contacts the external pressure roll bearing, and a second position wherein the ski does not contact the external pressure roll bearing.

In an embodiment, systems may include the mounting plate being a first mounting plate, the system including a second mounting plate, the strip shoe being attached to the second mounting plate, second mounting plate. In an embodiment, systems may include the internal pressure roll bearing being a first internal pressure roll bearing, and a second internal pressure roll bearing, the second mounting plate being attached to the second pressure roll bearing. In an embodiment, when the ski contacts the external pressure roll bearing, the strip shoe applies a force against fuser belt toward the external pressure roll for form a bend in the fuser belt at a portion of the strip shoe that contacts the fuser belt.

Exemplary embodiments are described herein. It is envisioned, however, that any system that incorporates features of apparatus and systems described herein are encompassed by the scope and spirit of the exemplary embodiments.

DETAILED DESCRIPTION

Figure 1:
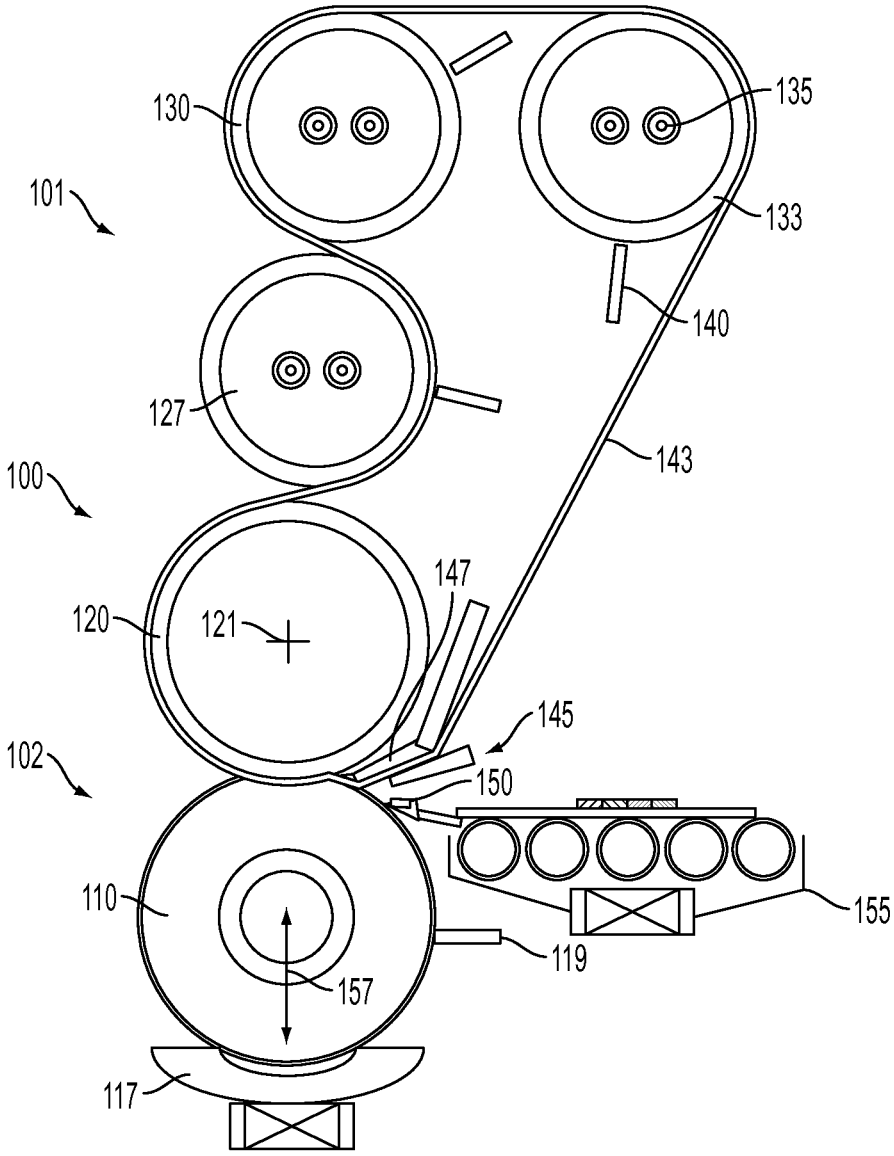
FIG. 1 shows a diagrammatical side view of a related art belt-roll fuser system having an internal pressure roll engaged with an external pressure roll of a belt-roll fuser implementing a related art nip profile and sheet-stripping configuration.

Exemplary embodiments are intended to cover all alternatives, modifications, and equivalents as may be included within the spirit and scope of the apparatus and systems as described herein.

Reference is made to the drawings to accommodate understanding of self-positioning stripping apparatus and systems for belt roll fuser systems. Belt roll fuser systems may be used in printing systems for fusing an image to a sheet at a fusing nip. In the drawings, like reference numerals are used throughout to designate similar or identical elements. The drawings depict various embodiments of illustrative self-stripping apparatus and systems.

Apparatus and systems of embodiments may include systems for printing images on substrates such as paper sheets. The printing process includes a fusing step wherein marking material such as toner is fused to the sheet using heat and pressure. Exemplary substrates may include media webs, such as a paper webs. Alternatively, the system may be configured to feed cut sheets to a fixing or fusing nip of the belt-roll fuser.

A related art belt-roll fuser system is shown in FIG. 1. Specifically, FIG. 1 shows a belt-roll fuser system 100. The belt-roll fuser system 100 may include a belt-roll fuser apparatus 101. The belt-roll fuser apparatus 101 may be configured to latch to and unlatch from a main frame portion 102 of the belt-roll fuser system 100. The belt-roll fuser main frame 102 may include an external pressure member 110, and the belt-roll fuser module 101 may include an internal pressure member 120. When the belt-roll fuser module is in a latched position, i.e., when the belt-roll fuser apparatus 101 is latched to the main frame 102, the internal pressure member 120 may be engaged with the external pressure member 110 to define a fusing nip. When the belt-roll fuser apparatus 101 is unlatched from the main frame 102, the belt-roll fuser apparatus 101 may be separated from the main frame 102 whereby access may be accommodated for, e.g., servicing or replacing components of the belt-roll fuser system 100.

The external pressure member 110 may be removable. Accordingly, when the belt-fuser apparatus 101 is separated from the belt-roll fuser main frame 102, the external pressure member 110 may be accessed for cleaning and/or servicing. For example, the external pressure member 110 may be customer replaceable.

The external pressure member 110 may be associated with a pressure roll cooling system. For example, FIG. 1 shows a pressure roll cooling system 117 positioned below an external pressure member 110. A pressure member monitoring device 119 may be included and configured for monitoring the pressure member 110. For example, monitoring device 119 may be a thermistor, such as a contact thermistor.

As shown in FIG. 1, the internal pressure member 120 may be engaged with the external pressure member 110 to form a fusing nip. The fusing nip may be formed when the belt-roll apparatus 101 is latched to the main frame 102 of the belt-roll fuser system 100.

The belt-roll fuser apparatus 101 may include a plurality of belt members. The belt members may be rolls, as shown, that rotatable about an axis, e.g., a longitudinal access, to facilitate movement of a fuser belt. The belt members may be rolls that support, clean, and/or steer the belt as it translates about the plurality of members and an internal pressure member. For example, FIG. 1 shows a belt-roll apparatus 101 including an internal pressure member 120, wherein the belt-roll apparatus 101 is positioned to engage the internal pressure member 120 with the external pressure member 110 of the belt-roll main frame 102. The internal pressure member 120 shown in FIG. 1 is a cylindrical member that is rotatable about longitudinal axis, e.g., a central longitudinal axis 121.

The belt-roll module 101 may include a cleaner member 127 positioned so that the internal pressure member 120 interposes the cleaner member 127 and the external pressure member 110 when the belt-roll module 101 is positioned to engage the internal pressure member 120 with the external pressure member 110 of the main frame of the belt-fuser system 100. The cleaner member 127 may be a rotatable member that facilitates support and translation of a belt. For example, the cleaner member 127 may be a roll, such as a cylindrical roll that is rotatable about its central longitudinal axis. The cleaner roll 127 may be associated with, for example, a web cleaning system or a belt cleaning system. A web cleaning system may include a plurality of members that facilitate cleaning of a web or belt of the belt-roll fuser system. The web cleaning system may be customer replaceable, facilitated by, e.g., the latching and unlatching operability of the belt-roll fuser module 101. The internal pressure member 120 may be associated with a metering system. A metering system may include one or more metering members, such as a media roll.

The belt-roll fuser apparatus 101 of FIG. 1 may include a belt member 130. The belt member 130 may be rotatable. For example, the belt member 130 may be a roll, such as a cylindrical roll that is rotatable about its central longitudinal axis. The belt-roll module 130 may include a tension member 133. The tension member 133 may be a roll, such as a cylindrical roll that is rotatable about its central longitudinal axis. The tension member 133 may be associated with a belt tensioner. The tension member 133 may be configured to accommodate belt tracking and steering. Each of the cleaner member 127, the belt member 130, and the tension member 133 may be heated. For example, the tension member 133 may include a heating element 135. One or more of the members of the belt-roll module 101 may be monitored by various monitoring devices 140. For example, the monitoring devices may be thermistors such as contact thermistors.

Each of the internal pressure member 120, the cleaner member 127, the belt member 130, and the tension member 133 may be configured to entrain a belt 143. The belt 143 may translate about the rotatable members, and may absorb heat from heated entraining rotatable members or rolls. The belt 143 may be replaceable. For example, the belt-fuser apparatus 101 may be positioned to accommodate access to components of the belt-roll fuser module 102 thereby enabling, e.g., user replacement of the belt 143. Belt thermistors (not shown) may be arranged about the belt 143.

The belt 143 may pass through a nip defined by the internal pressure member 120 of the belt-roll apparatus 101 and the external pressure member 110 when, e.g., the belt-roll apparatus 101 is latched to the main frame 102. Post-fusing processing components may be situated about the nip; specifically, about an exit of the nip. For example, an air knife 145 may be at the exit nip. Also, a stripping shoe 147 may be configured to interpose the internal pressure roll 120 and the belt 143 for bending the belt at a stripping angle to form a corner of the belt 143 at the nip exit at which the sheet may be stripped from the belt. The belt 143 may be wrapped around a corner of the stripping shoe 147, at which point paper may caused to leave a surface of the belt that extends in a process direction beyond the corner of the stripping shoe 147.

An exit sensor 150 may positioned at an exit of the fusing nip. A substrate having a fused image may be carried by a post-fuser transport system 155 after the substrate exits the fusing nip.

Figure 2A:
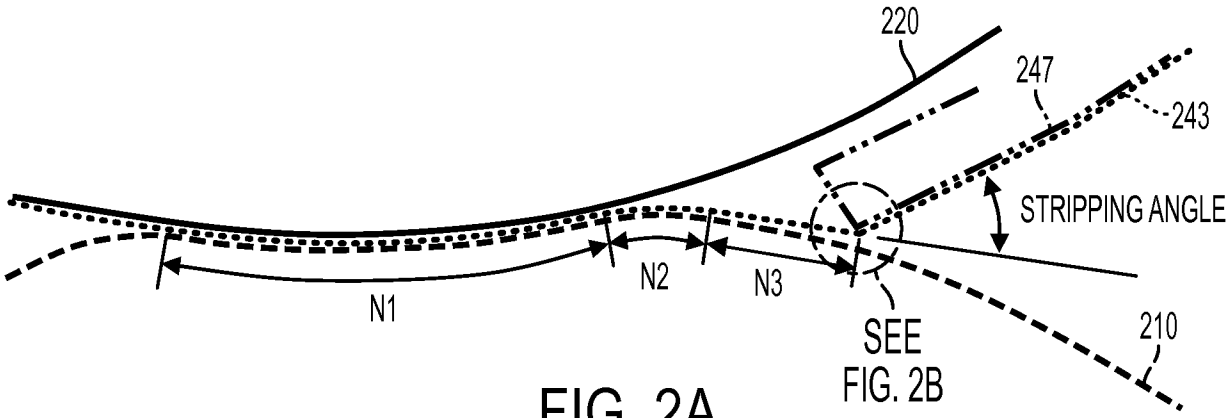
FIG. 2 shows a diagrammatical side view of a related art nip profile in a related art belt-roll fuser system.
Figure 2B:
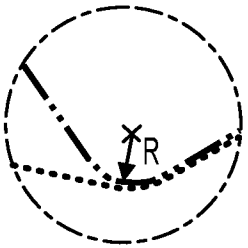

FIG. 2 shows a diagrammatical side view of a related art nip profile formed by a belt-roll fuser configuration of the type shown in FIG. 1. FIG. 2 shows a three zone nip (zones N1 (nip entrance), N2, and N3 (nip exit) formed by an external pressure roll 210 and an internal pressure roll, or fuser roll, 220. A fuser belt 243 is configured to wrap around a corner of a stripping shoe 247 at an exit of the nip, e.g., at zone N3 as shown in FIG. 2.

The zones of the related art nip profile include: N1, a high pressure nip zone (e.g., about 60 psi to about 80 psi); N2, a low pressure nip zone (e.g., about 6 psi to about 10 psi) where the fuser belt 243 changes direction, e.g., is guided in a direction away from the fuser roll 220; and N3, a nip zone (e.g., 0 psi) where there is substantially of the fuser belt 243 by the external pressure roll 210, and where the belt 243 from the external pressure roll 210 and is tangent with the stripping shoe 247 tip radius.

Image quality defects are typical at nip zones N2 and N3. For example, changes in a bend direction of a sheet as the sheet travels through the nip at zone N2, as shown in FIG. 2, may cause image defects. Also, as a lead edge of a sheet travels through nip zone N2, particularly if the sheet is a heavy weight sheet, the sheet may not conform to the external pressure member 210 at zone N2 where typically mere belt pressure exerts a force on the sheet toward the external pressure roll 210 at a pressure of about 6 to about 10 psi, for example. Due to a beam strength of the sheet, the sheet may separate from the belt surface during fusing, then retouch the belt surface as the beam strength increases. This may cause gloss defects, including icicles. Shortening the N2 nip zone to a particular length to avoid such defects may interfere with stripping functionality.

A sheet may stick to the belt 243 and/or to the external pressure roll 210 as the sheet travels through the N3 nip zone, depending on imaging density and image location. A sheet may separate and then re-touch the belt 243 causing image defects such as 'retack".

To ensure effective stripping, it is desirable to increase the stripping angle, increasing the angle at which the belt wraps around the stripping shoe. The stripping shoe must be positioned so that the shoe does not contact and damage the external pressure roll. Accordingly, variations in external pressure roll centerlines must be accounted for, limiting the effective stripping angle. Accordingly, a sheet leaves the hard nip at N2 before being stripped from belt fuser components until after a lead edge of the sheet reaches the strip shoe 247, past zone N3.

Figure 3:
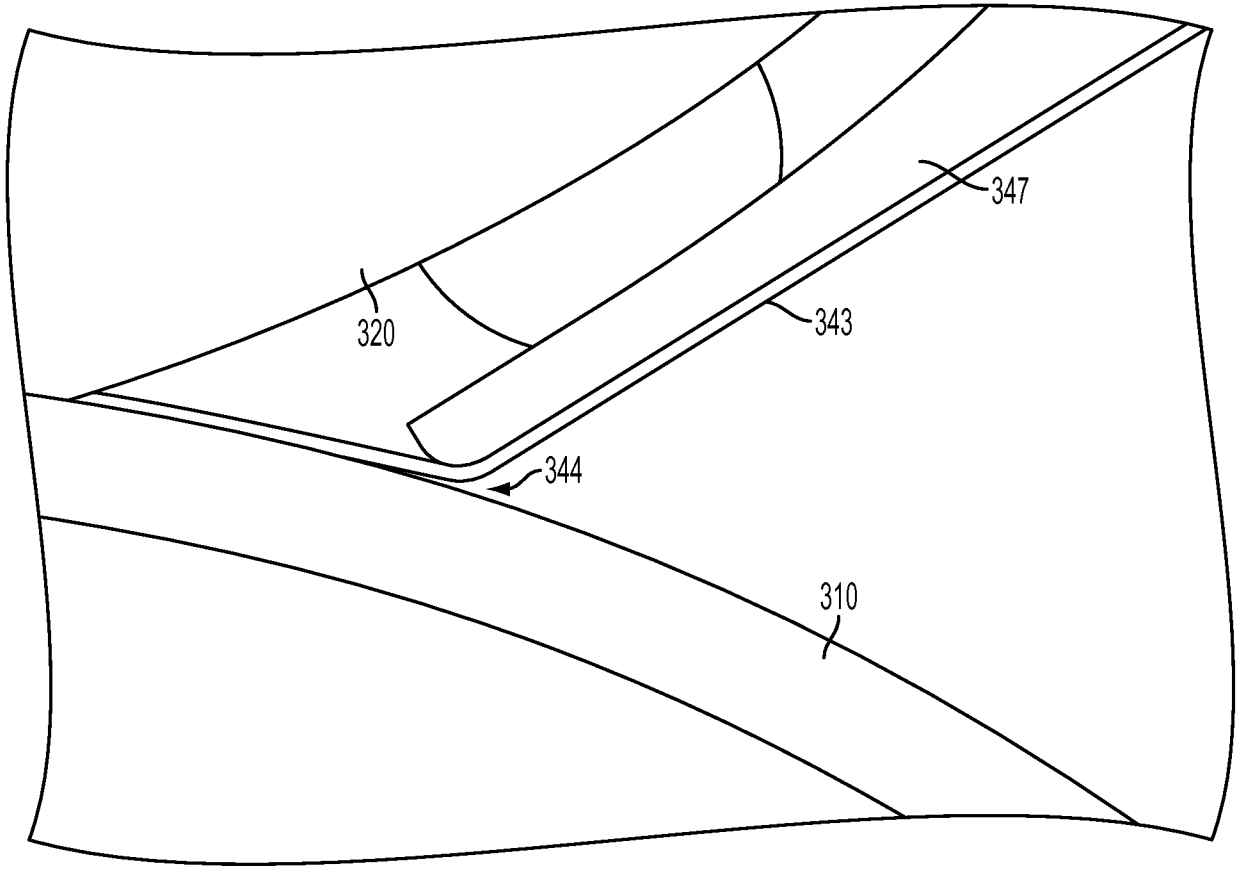
FIG. 3 shows a self-positioning belt-roll fuser stripping system in accordance with an exemplary embodiment.

FIG. 3 shows a self-stripping belt roll fuser system in accordance with an embodiment. The self-stripping belt roll fuser system shown in FIG. 3 includes an external pressure member such as a roll 310. The system may include a belt roll apparatus that defines a fusing nip with the external pressure roll 310. A surface of the external pressure roll may be a hard surface comprising a hard material such as metal or ceramic. The hard surface may prevent damage to the external roll caused by the stripping shoe.

The belt roll fuser apparatus may include an internal pressure roll 320. The internal pressure roll or fuser roll 320 may entrain a fuser belt 343. The internal pressure roll 320 may comprise a soft surface, and may be formed of, for example, rubber. The belt 343 may be formed of polyimide viton. The belt 343 and pressure rolls 322 may be configured to form a composite fusing nip when operably engaged with the external pressure roll 310, wherein internal the pressure roll 320 contacts external pressure roll 310 to form the fusing nip A strip shoe 346 may be configured to apply a force against the belt 343 toward the external pressure roll 310. The strip shoe 346 may form a metal bar for example. The angle at which the belt wraps around the strip shoe is larger than the stripping angle shown in FIG. 2. Further, the stripping shoe 347 is positioned closer to the external pressure roll 310, minimizing the N3 zone in comparison with the N3 zone in FIG. 2, and causing the nip exit 344 to be closer to the stripping shoe than the nip exit in FIG. 2, thereby reducing a potential for image quality defects.

The stripping shoe may be mounted on a pivoting plate system. The pivoting plate system may be mounted on bearings attached to the internal pressure roll 320. A spring force may be implemented for biasing the pivoting system inward and toward the nip, in a clockwise direction with respect to FIG. 2. For example, a spring may be attached to a system frame and the pivoting system.

Figure 4:
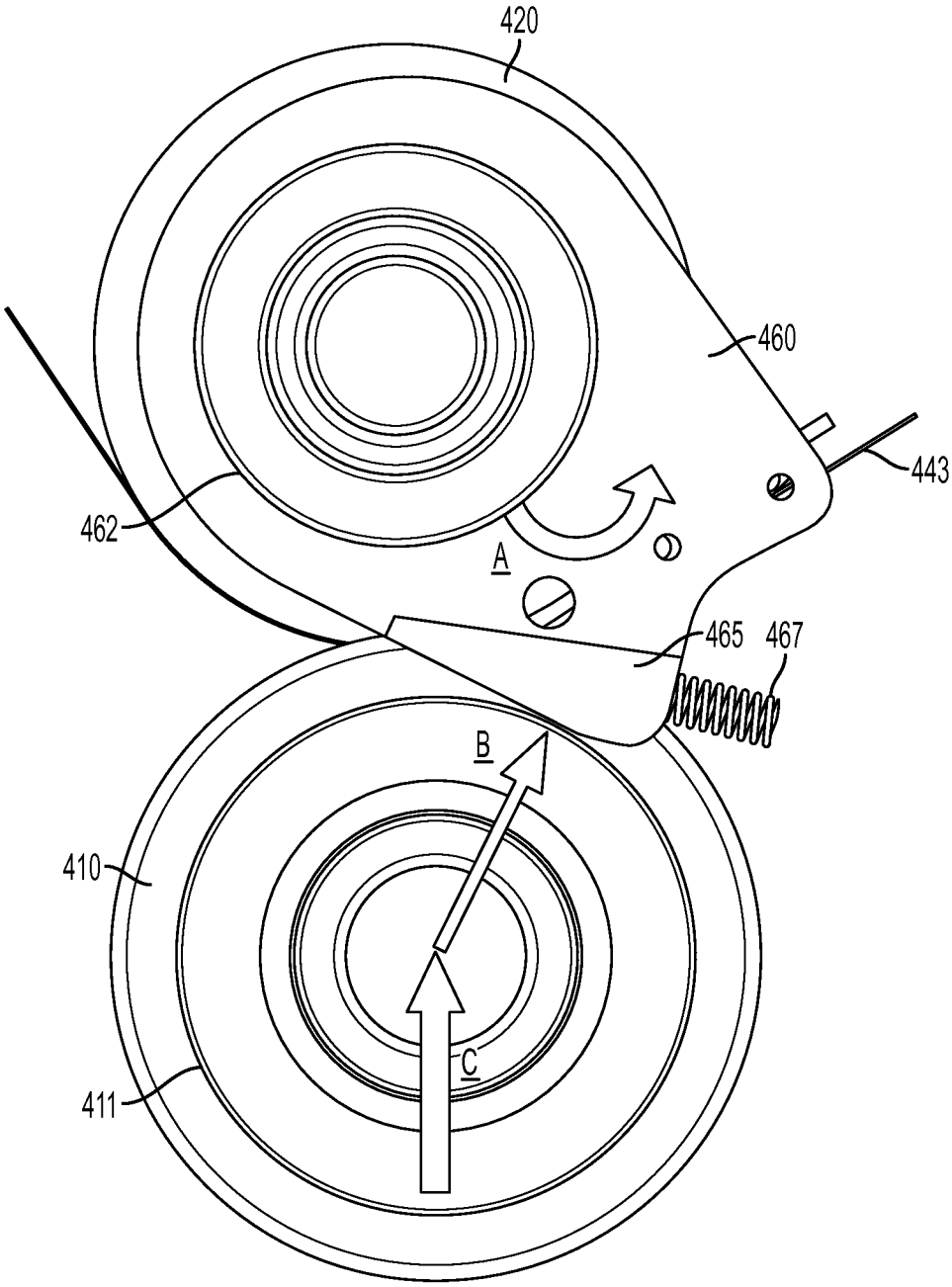
FIG. 4 shows a self-positioning belt-roll fuser stripping system in accordance with an exemplary embodiment.

FIG. 4 shows a self-position stripping system for use in a belt fuser system. FIG. 4 shows an external pressure roll 410. The external pressure roll 410 may include a hard surface. The external pressure roll 410 may include an external pressure roll bearing 411 that is attached to the internal pressure roll.

FIG. 4 shows an internal pressure roll 410, a fuser belt 443 entrained by the internal pressure roll 420, a strip shoe mounting plate 460, an internal pressure roll bearing 462, ski 465, and biasing system 467. The internal pressure roll 420 may include an internal pressure roll bearing 462 attached to the internal pressure roll 420. The mounting plate 460 may be attached to the internal pressure roll bearing 462. The ski 465 may be attached to the mounting plate 460.

When the internal pressure roll 420 is engaged with the external pressure roll 410 to form a fusing nip, the mounting plate 460, internal pressure roll bearing 462, and external pressure roll bearing 411 may be configured so that a ski 465 attached to the mounting plate contacts the external pressure roll bearing 411. For example, the ski 465 may be constructed and arranged to slidably contact the external pressure roll bearing 411, enabling the mounting plate to track the position of the external pressure roll 410, and preventing the stripping shoe attached to the plate 460 from extending beyond a desired distance between the shoe and a surface of the external pressure roll 410.

A mounting plate 460 may be included on either or both sides of the internal pressure roll 420. Similarly, the internal pressure bearing 462, external pressure roll bearing 411, and ski 465 may be configured on either or both sides of the internal and external pressure rolls.

A biasing system 467 may include, for example, a spring attached to a frame of the belt roll fuser apparatus. The spring 467 may be configured to bias the mounting plate 460, which may be rotatably attached to the internal pressure roll bearing 462, toward the nip so that the ski 465 is forced against the external pressure roll 411. Accordingly, the shoe may be forced against the belt 443, the shoe being positioned a desired distance from the external pressure roll 410.

As the external pressure roll 410 is raised to engage the internal pressure roll 420 for forming a fusing nip for a printing operation, an outside diameter of the external pressure roll bearing 411 may be configured to engage the ski(s) 465, causing the plate to rotate counter clockwise in a direction "A" by applying a force in a direction "B" until the external pressure roll 410 has finished moving in a direction "C" to form the nip. The configuration accommodates self-location or automatic position of the tip of the strip shoe relative to the external pressure roll 410. Because the plate system tracks the location of the external pressure roll by way of the external pressure roll bearing 411, variation in a location of internal pressure roll 420 and external pressure 410 rotational axis centerlines would have little effect on a location of the strip shoe relative to the surface of the external pressure roll 410.

Figure 5:
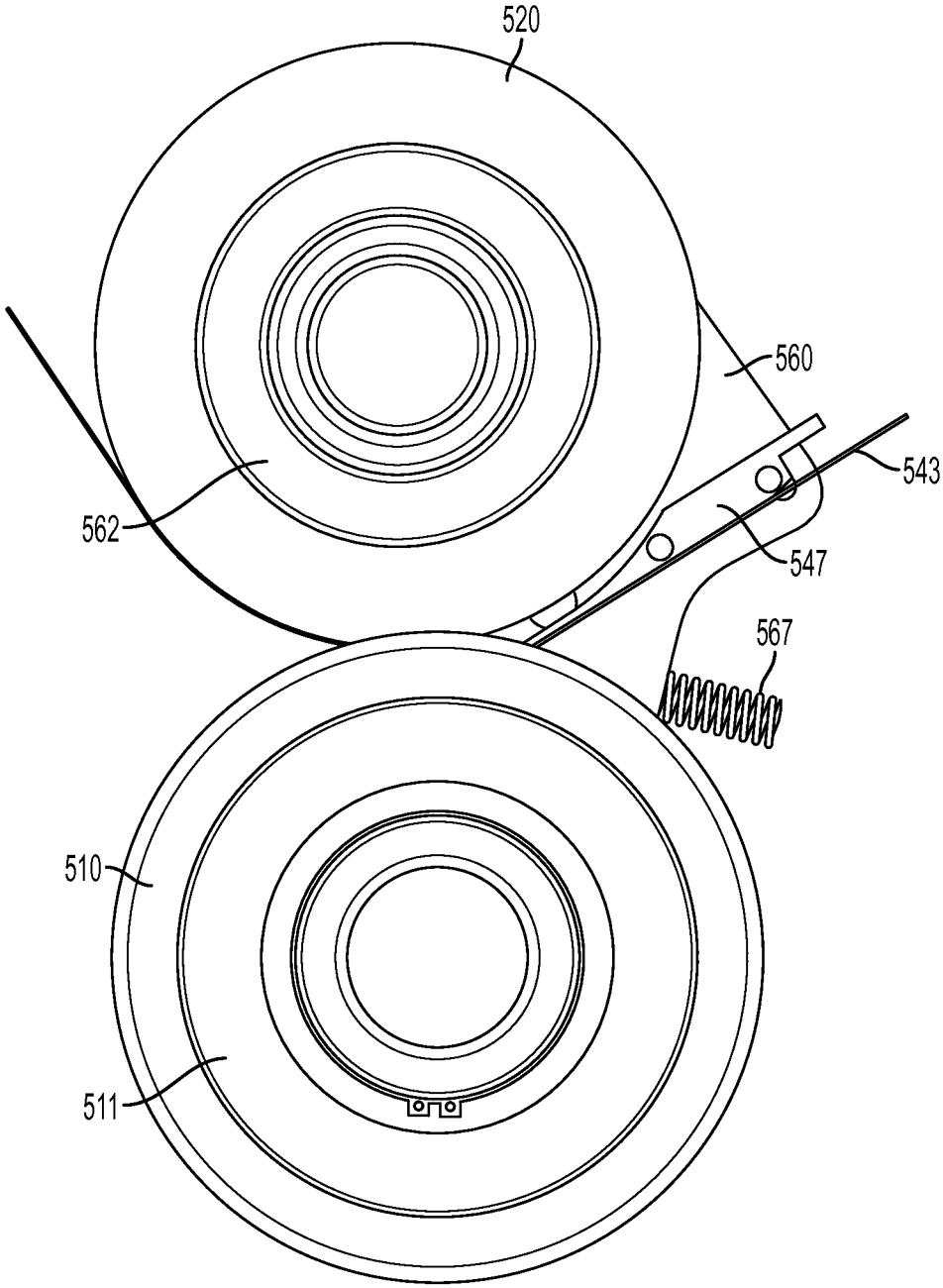
FIG. 5 shows a self-positioning belt-roll fuser stripping system in accordance with an exemplary embodiment.

FIG. 5 shows a diagrammatical cross-sectional side view of a self-positioning stripping system in a belt roll fuser system in accordance with an embodiment. FIG. 5 shows a self-position stripping system for use in a belt fuser system. FIG. 5 shows an external pressure roll 510. The external pressure roll 510 may include a hard surface. The external pressure roll 510 may include an external pressure roll bearing 511 that is attached to the external pressure roll 510.

FIG. 5 shows an internal pressure roll 520, a fuser belt 543 entrained by the internal pressure roll 520, a strip shoe mounting plate 560, an internal pressure roll bearing 562, ski 565, and biasing system 567. The internal pressure roll 520 may include an internal pressure roll bearing 462 attached to the internal pressure roll 520. The mounting plate 560 may be attached to the internal pressure roll bearing 562. The ski 565 may be attached to the mounting plate 560.

When the internal pressure roll 520 is engaged with the external pressure roll 510 to form a fusing nip, the mounting plate 560, internal pressure roll bearing 562, and external pressure roll bearing 511 may be configured so that a ski 565 attached to the mounting plate contacts the external pressure roll bearing 511. For example, the ski 565 may be constructed and arranged to contact the external pressure roll bearing 511, enabling the mounting plate to track the position of the external pressure roll 510, and preventing the stripping shoe attached to the plate 560 from extending beyond a desired distance between the shoe and a surface of the external pressure roll 510, the mounting plate 560 being biased toward the external pressure roll 510. A mounting plate 560 may be included on either or both sides of the internal pressure roll 520. Similarly, the internal pressure bearing 562, external pressure roll bearing 511, and ski 565 may be configured on either or both sides of the internal and external pressure rolls.

A strip shoe 547 may be attached to the mounting plate 560. In an embodiment having two mounting plates, the strip shoe 547 may be attached to both mounting plates, one mounting plate being attached to each side of the strip shoe assembly. The strip shoe 547 mounted to the one or more mounting plates 560 may be configured to apply a force to the fuser belt 547 so that the belt 547 wraps around a tip or corner of the strip shoe 547, corresponding to a point at which a sheet that exist the fusing nip separates from the fuser belt 543. The strip shoe 547 mounted to the one or more mounting plates 560 may be configured for applying a force to the belt 543 that minimizes a low pressure zone at the nip exit where no pressure or mere belt tension is applied to the sheet.

The mounting plate 560 may be configured to be rotatable about the internal pressure roll bearings 562 in both a clockwise and a counter-clockwise direction. The mounting plate 560 may be rotated counter-clockwise in a belt fuser system for moving the stripping finger away from the external pressure roll, thereby applying a lesser force than the strip shoe 547 would apply to the belt 543 in the configuration shown in FIG. 5, for example. As such, the fusing nip length may be shortened to include only a high pressure nip zone by rotating the mounting plate 560 to move the strip shoe 547 in a direction away from the external pressure roll 510. Such a configuration may be implemented, for example, for print jobs including heavier weight paper sheets that have a beam strength that allows fusing without the aid of a strip shoe, which would otherwise increase the potential for image and/or gloss defects.

A biasing system 567 may include, for example, a spring attached to a frame of the belt roll fuser apparatus. The spring 567 may be configured to bias the mounting plate 560, which may be attached to the internal pressure roll bearing 562, toward the nip so that the ski 565 is forced against the external pressure roll 511. Accordingly, the shoe may be forced against the belt 543, the shoe 547 being positioned a desired distance from the external pressure roll 510.

As the external pressure roll 510 is raised to engage the internal pressure roll 520 for forming a fusing nip for a printing operation, an outside diameter of the external pressure roll bearing 511 may be configured to engage the ski(s) 565, causing the plate to rotate counter clockwise in a direction "A" by applying a force in a direction "B" until the external pressure roll 510 has finished moving in a direction "C" to form the nip. The configuration accommodates self-location or automatic position of the tip of the strip shoe 547 relative to the external pressure roll 510. Because the plate system tracks the location of the external pressure roll by way of the external pressure roll bearing 511, variation in a location of internal pressure roll 520 and external pressure 510 rotational axis centerlines would have little effect on a location of the strip shoe 547 relative to the surface of the external pressure roll 510.

While apparatus and systems for self-positioning stripping system are described in relationship to exemplary embodiments, many alternatives, modifications, and variations would be apparent to those skilled in the art. Accordingly, embodiments of apparatus and systems as set forth herein are intended to be illustrative, not limiting. There are changes that may be made without departing from the spirit and scope of the exemplary embodiments.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A belt-roll fuser stripping apparatus, comprising:

a mounting plate for mounting a stripping shoe, the mounting plate being configured to movably connect to an internal pressure roll; and an internal pressure roll bearing, the internal pressure roll bearing being attached to the internal pressure roll, and the mounting plate being attached to the internal pressure roll bearing whereby the mounting plate is movably connected to the internal pressure roll;

wherein the stripping shoe for stripping a sheet from a fuser belt is attached to the mounting plate.

2. The apparatus of claim 1, comprising:

a fuser belt, the fuser belt being entrained by at least the internal pressure roll, the fuser belt having an internal pressure roll contact side and a sheet contact side, the fuser belt wrapping around the stripping shoe whereby the stripping shoe contacts the roll contact side of the fuser belt to angle the fuser belt.

3. The apparatus of claim 1, the internal pressure roll further comprising:

a conformable surface.

4. The apparatus of claim 1, the internal pressure roll further comprising:

a soft surface comprising rubber.

5. The apparatus of claim 2, comprising the internal pressure roll bearing being configured to permit rotation of the mounting plate about a rotational axis of the internal pressure roll.

6. The apparatus of claim 5, whereby a force applied to the fuser belt by the stripping shoe may be adjusted by moving the mounting plate about the internal pressure roll bearing.

7. The apparatus of claim 5, comprising:

a mounting plate ski, the mounting plate ski being configured to limit rotation of the mounting plate about a rotational axis of the internal pressure roll.

8. The apparatus of claim 7, comprising the mounting plate ski being attached to the mounting plate.

9. The apparatus of claim 7, comprising the mounting plate ski being configured for restricting movement of the mounting plate whereby the stripping shoe may be automatically positioned to apply a desired pressure to the roll contact side of the fuser belt.

10. A self-positioning stripping system, comprising:

a mounting plate, the mounting plate configured for supporting a strip shoe;

an internal pressure roll;

an internal pressure roll bearing, the internal pressure roll bearing being connected to the internal pressure roll, the mounting plate being attached to the internal pressure roll bearing whereby the mounting plate is movable about a rotational axis of the internal pressure roll.

11. The system of claim 10, comprising:

an external pressure roll.

12. The system of claim 11, comprising the internal pressure roll having soft surface, and the external pressure roll having a hard surface.

13. The system of claim 11, comprising the mounting plate being spring biased, the mounting plate being biased toward the external pressure roll when the external pressure roll is engaged with the internal pressure roll to define a fusing nip.

14. The system of claim 13, comprising:

a mounting plate ski, the mounting plate being spring biased toward a first direction;

an external pressure roll bearing, the external pressure bearing being movably attached to the external pressure roll, the mounting plate ski being configured to contact the external pressure roll bearing.

15. The system of claim 14, comprising the mounting plate being biased by a spring that applies a biasing force in the first direction that causes the mounting plate to move toward the external pressure roll, the ski being configured to contact the external pressure roll bearing whereby the external pressure roll bearing applies a force in a second direction that opposes the first direction of the biasing force.

16. The system of claim 15, comprising the mounting plate being movable to and from a first position wherein the ski contacts the external pressure roll bearing, and a second position wherein the ski does not contact the external pressure roll bearing.

17. The system of claim 16, wherein the mounting plate is a first mounting plate, the system comprising:

a second mounting plate, the strip shoe being attached to the second mounting plate, second mounting plate.

18. The system of claim 17, the internal pressure roll bearing being a first internal pressure roll bearing, the system comprising:

a second internal pressure roll bearing, the second mounting plate being attached to the second pressure roll bearing.

19. The system of claim 16, wherein when the ski contacts the external pressure roll bearing, the strip shoe applies a force against fuser belt toward the external pressure roll for form a bend in the fuser belt at a portion of the strip shoe that contacts the fuser belt.

* * * * *